US009857140B2

(12) United States Patent
Italia

(10) Patent No.: US 9,857,140 B2
(45) Date of Patent: Jan. 2, 2018

(54) LOADER SPACER RING

(71) Applicant: GI Sportz, Inc., St. Laurent (CA)

(72) Inventor: Richmond Italia, Dorval (CA)

(73) Assignee: GI Sportz, Inc., Quebec (CA)

( * ) Notice: Subject to any disclaimer, the term of this patent is extended or adjusted under 35 U.S.C. 154(b) by 0 days.

(21) Appl. No.: 14/858,378

(22) Filed: Sep. 18, 2015

(65) Prior Publication Data

US 2017/0082391 A1 Mar. 23, 2017

(51) Int. Cl.

| | |
|---|---|
| ***F41B 11/00*** | (2013.01) |
| ***F41B 11/52*** | (2013.01) |
| ***F41B 11/53*** | (2013.01) |
| ***B65D 21/08*** | (2006.01) |

(52) U.S. Cl.

CPC ..... *F41B 11/52* (2013.01); *B65D 21/083* (2013.01); *F41B 11/53* (2013.01)

(58) Field of Classification Search

CPC ..... B65D 21/08; B65D 21/083; F41B 11/52; F41B 11/53

See application file for complete search history.

(56) References Cited

U.S. PATENT DOCUMENTS 1,362,878 A * 12/1920 Ladd ..... A47J 27/0808 220/323
2,545,577 A * 3/1951 Griffin ..... A47J 27/084 220/301
3,203,579 A * 8/1965 Reynolds ..... B60T 11/26 188/1.11 R
4,852,757 A * 8/1989 Gold ..... B65D 21/083 220/4.03
6,276,547 B1 * 8/2001 Petryna ..... B65D 21/083 220/4.03
7,322,347 B2 * 1/2008 Broersma ..... F41B 11/53 124/49
8,235,030 B2 * 8/2012 Kaakkola ..... F41B 11/52 124/49
9,297,605 B2 * 3/2016 Spurlock ..... F41B 11/53
2008/0017178 A1 * 1/2008 Marques ..... F41B 11/53 124/51.1
2010/0126485 A1 * 5/2010 Neumaster ..... F41B 11/57 124/51.1
2011/0073092 A1 * 3/2011 Yeh ..... F41B 11/53 124/49
2011/0204048 A1 * 8/2011 Carino ..... A45F 3/18 220/4.03

* cited by examiner

*Primary Examiner* — John Ricci
(74) *Attorney, Agent, or Firm* — Craig R. Rogers; Simple IP Law, P.C.

(57) ABSTRACT

A loader may be provided having two or more shell segments or sections separable from each other, wherein the shell segments help define an internal chamber of the loader that is capable of housing a quantity of ammunition for a connected gun. A spacer ring can be provided to fit between at least two of the shell segments. When the loader shell segments are reattached having the spacer ring arranged therebetween, the capacity of the loader may be increased.

20 Claims, 5 Drawing Sheets

LOADER SPACER RING

FIELD OF THE INVENTION

This invention relates generally to loaders, for instance such as is used in the sports of paintball and/or airsoft. More specifically, this invention relates primarily to an expansion ring that can be added to a loader to add capacity.

BACKGROUND OF THE INVENTION

In the sports of paintball and airsoft, pneumatic guns are used to deliver the paintball or airsoft pellet to a target. Loaders may be used to hold a quantity of paintballs or airsoft pellets and to supply those projectiles to the pneumatic gun. It may be desirable to have a loader with increased capacity to enable longer play times between reloading.

SUMMARY OF THE INVENTION

According to one aspect of this invention, an expansion or spacer ring is provided to enable a loader to hold a larger quantity of paintballs.

Numerous other potential embodiments are also contemplated as being within the scope of the present invention and will be readily apparent to those of skill in the art based on the following detailed description.

BRIEF SUMMARY OF THE DRAWINGS

The foregoing and additional objects and advantages of the present invention will become more readily apparent through the following detailed description, made with reference to the accompanying drawings, in which.

DETAILED DESCRIPTION

Various preferred aspects of the present inventive concepts will now be described in detail with reference to the accompanying figures. It should be noted, however, that the following description is provided by way of example only and not of limitation and that many other implementations and embodiments of the present inventive concepts will be readily apparent to those skilled in the art based on the disclosure herein. The scope of the invention is therefore not limited to the particular embodiments described herein.

Figure 1A:
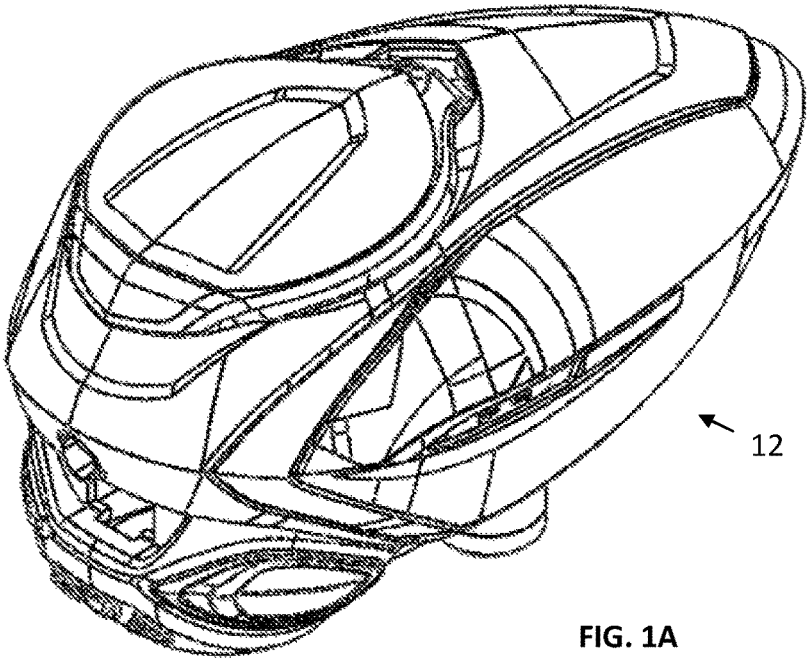
FIGS. 1A and 1B are a somewhat schematic perspective view and side view, respectively, of a paintball loader without a spacer or expansion ring.
Figure 1B:
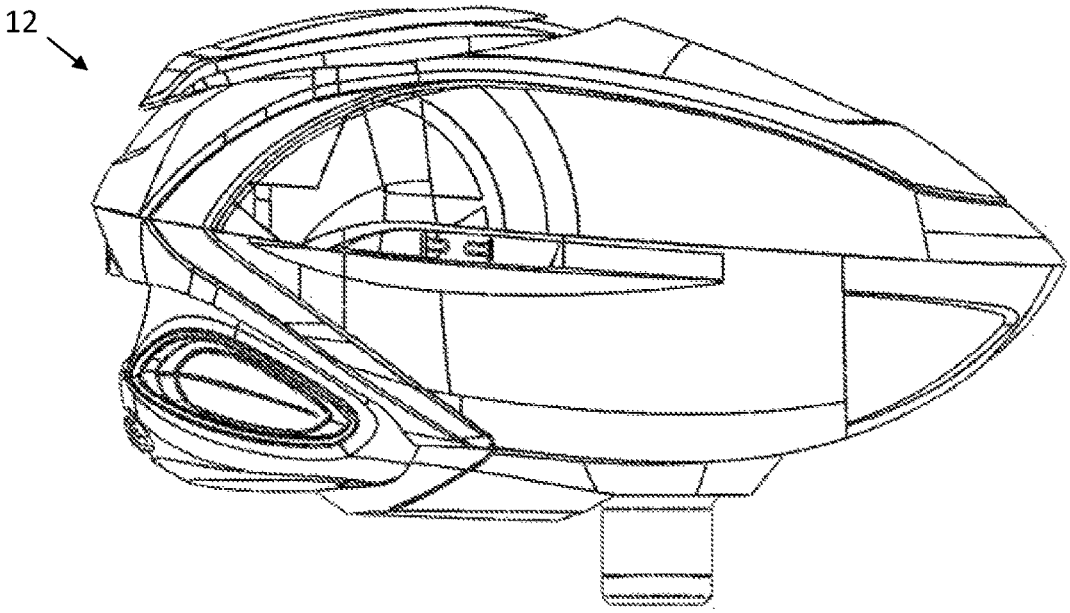
Figure 2A:
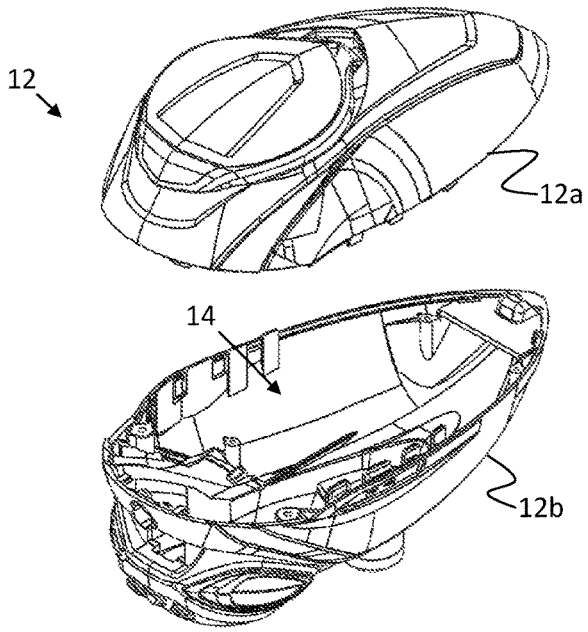
FIGS. 2A and 2B are a somewhat schematic exploded perspective view and side view, respectively, of the loader of FIGS. 1A and 1B showing two halves of the loader shell separated from each other.
Figure 2B:
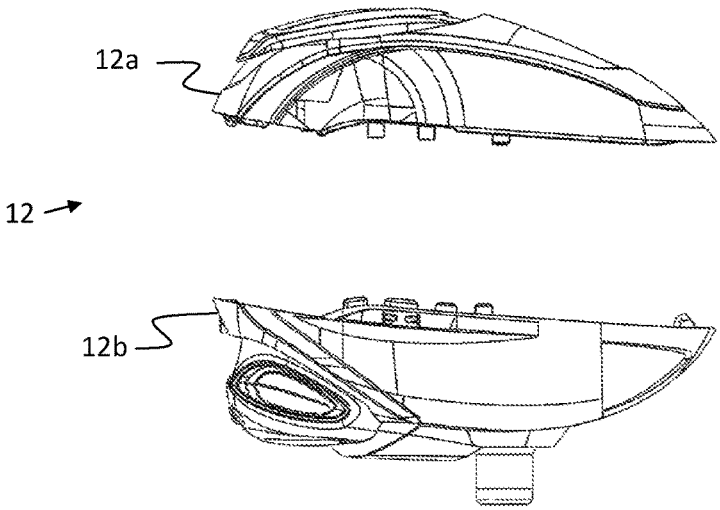
Figure 3A:
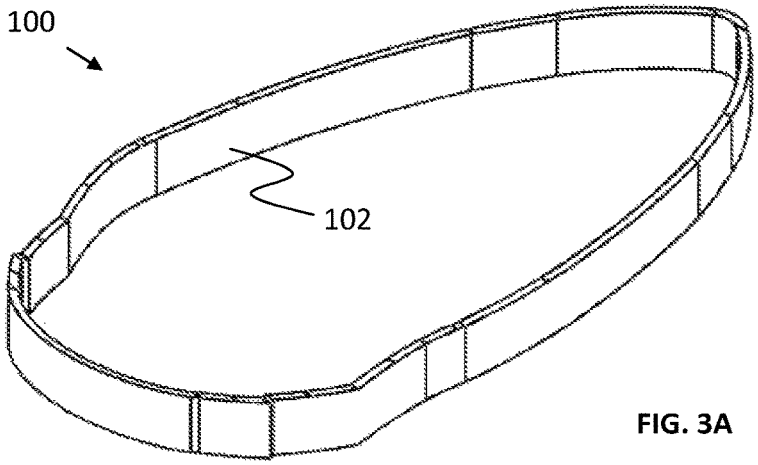
FIGS. 3A and 3B are a somewhat schematic perspective view and side view, respectively, of an expansion or spacer ring configured to be inserted between two halves of a loader shell according to an embodiment of the present inventive concepts.
Figure 3B:
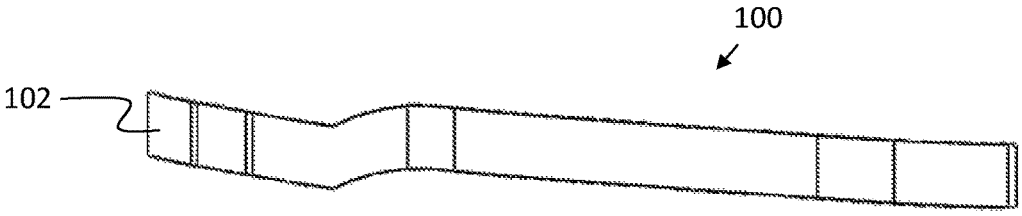
Figure 4A:
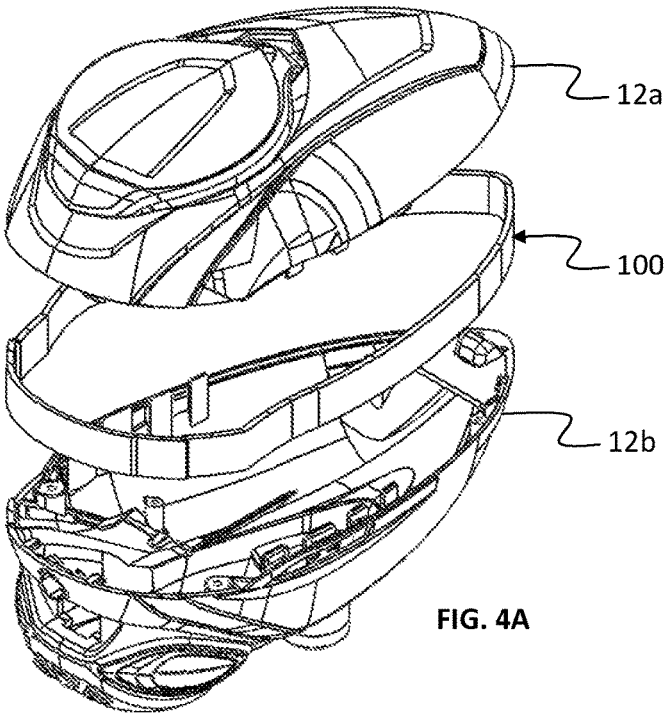
FIGS. 4A and 4B are a somewhat schematic exploded perspective view and side view, respectively, of the loader of FIGS. 1A and 1B showing the two halves of the shell separated from each other with the expansion or spacer ring of FIGS. 3A and 3B inserted between the two halves according to an embodiment of the present inventive concepts.
Figure 4B:
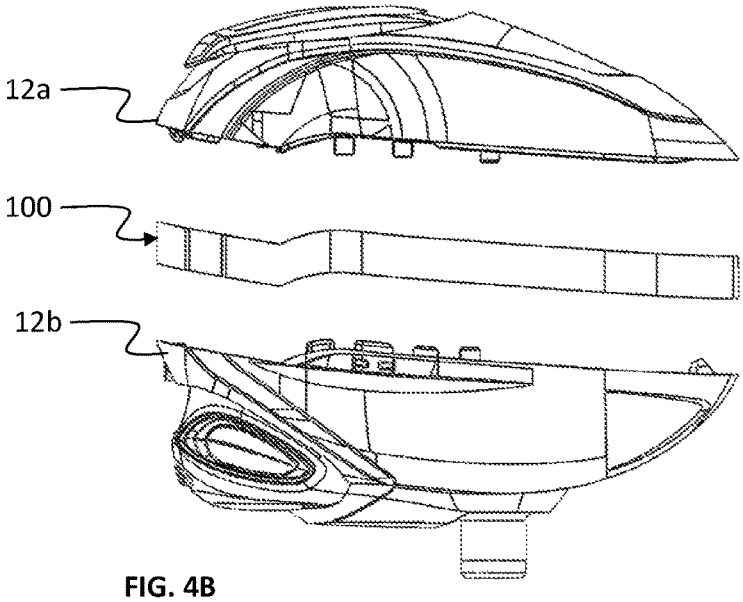
Figure 5A:
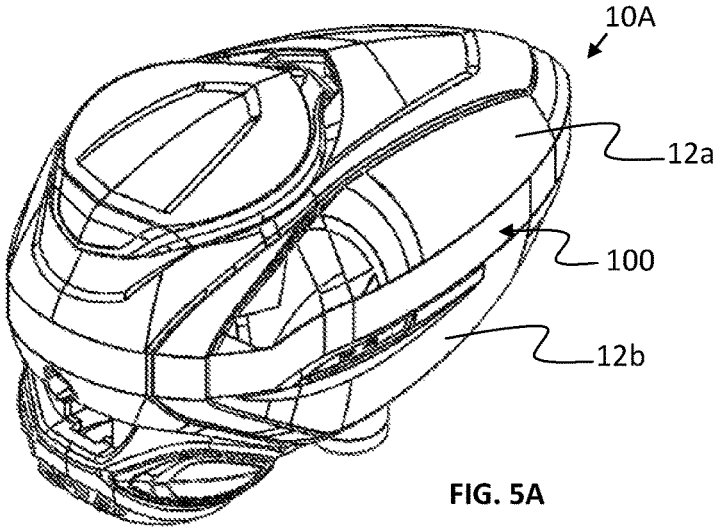
FIGS. 5A and 5B are a somewhat schematic perspective view and side view, respectively, of the loader of FIGS. 1A and 1B having the spacer or expansion ring of FIGS. 3A and 3B arranged therein in an assembled form.
Figure 5B:
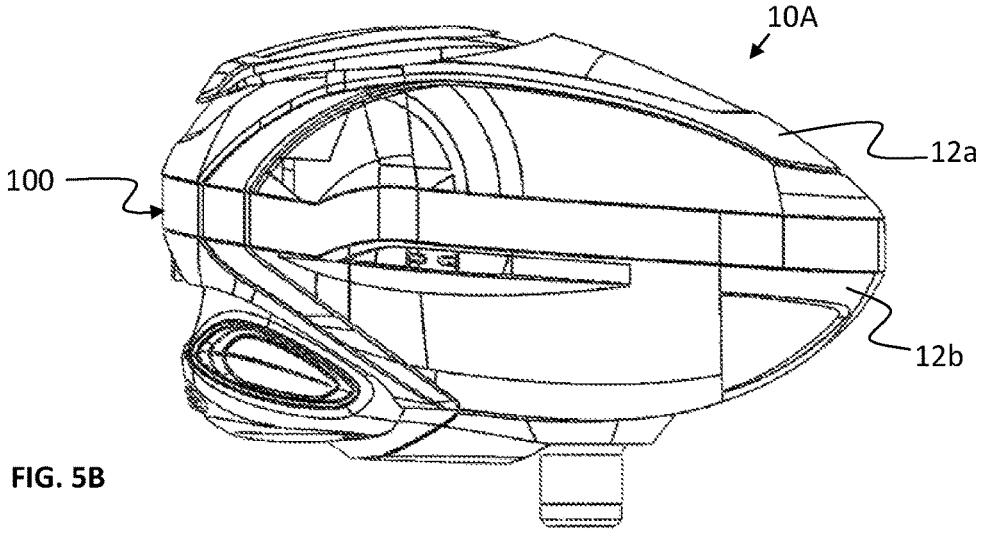

FIGS. 1A-5B provide illustrations of a loader and spacer ring constructed according to principles of the present inventive concepts. Referring to FIGS. 1A-5B, a loader 10 may be constructed having two or more segments or sections (i.e., half shells 12*a*, 12*b*) that may be separated from each other. In this embodiment, a spacer or expansion ring 100 can be configured to fit between the two half shells 12*a*, 12*b* to expand the capacity of the loader 10. As shown in FIGS. 5A and 5B, the assembled loader 10A having the spacer ring 100 fitted therein has a larger capacity than the loader 10 without the spacer ring 100 (see FIGS. 1A and 1B).

To add the spacer ring 100, the two halves 12*a*, 12*b* of the loader shell 12 may be separated from each other. The loader halves 12*a*, 12*b* may, for instance, be attached by screws or other fasteners (not shown), or they may be connected together by latches, tabs, or other readily releasable mechanical connections (also not shown). Once separated, the spacer ring 100 can be inserted between the two halves 12*a*, 12*b*, and the two halves 12*a*, 12*b* can then be reattached to each other with the spacer ring 100 arranged therebetween. In this manner, the capacity of the loader 10 can be increased.

The spacer ring 100 preferably comprises a ring-shaped housing 102 that surrounds an inner cavity or chamber 14 within the paintball loader 10. By expanding the size of the paintball loader housing, the spacer ring 100 expands the volume of the internal chamber housing the paintballs and increases the loader capacity.

Having described and illustrated the principles of the inventive concepts with respect to a preferred embodiment thereof, it should be apparent that those concepts can be modified in arrangement and detail without departing from such principles. As is evident from the foregoing description, numerous variations and modifications are possible within the spirit and scope of the present inventive concepts. The specification therefore should not be read to limit the scope of the claims.

What is claimed is:

1. A paintball loader for a paintball gun comprising a loader spacer ring configured to expand the holding capacity of the paintball loader, said paintball loader being separable into multiple sections wherein a lower section comprises a feed neck configured to connect to and supply paintballs to a feed tube of the paintball gun, and said spacer ring comprising:

a ring shaped housing configured to fit between sections of the paintball loader and expand a volume of a chamber arranged within the paintball loader to expand the holding capacity of the paintball loader.

2. A paintball loader according to claim 1, wherein the multiple sections comprise two half shells and wherein the spacer ring is configured to surround an internal chamber of the paintball loader when operatively installed between the two half shells.

3. A paintball loader according to claim 1, wherein the paintball loader comprises:

a housing providing the chamber, the chamber configured to house a quantity of ammunition for a connected paintball gun, the housing having multiple sections separable from each other; and wherein each section of the housing is configured to provide a portion of the volume of the chamber.

4. A paintball loader according to claim 3, wherein the multiple sections comprise a top shell and a bottom shell, and wherein the spacer ring is arranged between the top shell and the bottom shell to expand the volume of the chamber.

5. A paintball loader according to claim 3, wherein the loader spacer ring comprises a ring shaped housing that surrounds the chamber of the loader when operatively arranged between at least two sections of the loader.

6. A paintball loader according to claim 1, wherein the loader spacer ring comprises no connection mechanisms for securing the spacer to the loader sections.

7. A method of expanding a holding capacity of a loader for a pneumatic gun, wherein said loader comprises multiple separable sections and a feed neck for connecting to and supplying ammunition to a feed tube of the pneumatic gun, said method comprising:

separating at least two sections of the loader, wherein the at least two sections help define an internal chamber of the loader capable of housing a quantity of ammunition for the pneumatic gun;

arranging a spacer ring between the at least two sections of the loader; and reattaching the at least two sections of the loader to each other with the spacer ring arranged between the at least two sections such that a volume of the internal chamber is increased.

8. A method according to claim 7, wherein the at least two sections comprise a top shell and a bottom shell.

9. A method according to claim 8, wherein the spacer ring comprises a ring shaped housing configured to surround the internal chamber of the loader.

10. A method according to claim 7, wherein the pneumatic gun is a paintball gun.

11. A method according to claim 7, wherein each section of the loader is configured to provide a portion of the volume of the internal chamber.

12. A method according to claim 7, wherein reattaching the at least two sections of the loader comprises reattaching the at least two sections directly to each other with the spacer ring arranged between them.

13. A paintball loader for a paintball gun, said paintball loader including a loader spacer configured to expand the holding capacity of the paintball loader, said paintball loader having a feed neck for connecting with a feed tube of a paintball gun and being separable into multiple sections, said loader spacer comprising:

a housing configured to fit between sections of the paintball loader, each section of the paintball loader defining a portion of a chamber and providing a portion of an internal volume for holding a quantity of paintballs, said housing configured to surround a portion of the chamber and expand the internal volume of the chamber to increase the holding capacity of the paintball loader.

14. A paintball loader according to claim 13, wherein the sections of the paintball loader comprise two half shells, wherein each half shell comprises an internal volume configured to provide part of the internal volume of the chamber, and wherein the loader spacer is configured to define an additional portion of the chamber of the paintball loader when operatively installed between the two half shells.

15. A paintball loader according to claim 14, wherein the housing is a ring shaped housing configured to mate between the two half shells of the loader and surround a central portion of the chamber.

16. A paintball loader according to claim 13, wherein the multiple sections comprise a top shell and a bottom shell, and wherein the loader spacer is arranged between the top shell and the bottom shell to expand the volume of the internal chamber.

17. A paintball loader according to claim 13, wherein the spacer comprises a ring shaped housing that surrounds the chamber of the loader when operatively arranged between at least two other sections of the paintball loader.

18. A paintball loader according to claim 17, wherein the multiple sections of the paintball loader can be reattached directly to each other with the loader spacer arranged therebetween.

19. A paintball loader according to claim 18, wherein the at least two sections comprise a top shell and a bottom shell, and wherein the top shell is connected directly to the bottom shell with the loader spacer arranged therebetween.

20. A paintball loader according to claim 13, wherein the loader spacer comprises no connection mechanisms for securing the spacer to either the top or bottom shell.

* * * * *